US006957474B2

(12) United States Patent
Fleissner

(10) Patent No.: US 6,957,474 B2
(45) Date of Patent: Oct. 25, 2005

(54) SUCTION DEVICE FOR USE IN A TEXTILE MACHINE, ESPECIALLY A WATER JET WEAVING INSTALLATION

(75) Inventor: Gerold Fleissner, Zug (CH)

(73) Assignee: Fleissner GmbH & Co. Maschinenfabrik, Egelsbach (DE)

( * ) Notice: Subject to any disclaimer, the term of this patent is extended or adjusted under 35 U.S.C. 154(b) by 251 days.

(21) Appl. No.: 10/257,135

(22) PCT Filed: Apr. 14, 2001

(86) PCT No.: PCT/EP01/04274

§ 371 (c)(1),
(2), (4) Date: Jan. 24, 2003

(87) PCT Pub. No.: WO01/79598

PCT Pub. Date: Oct. 25, 2001

(65) Prior Publication Data

US 2003/0182780 A1 Oct. 2, 2003

(30) Foreign Application Priority Data

Apr. 17, 2000 (DE) ..... 100 18 920

(51) Int. Cl.[7] ..... D06B 1/02
(52) U.S. Cl. ..... 28/104; 28/167
(58) Field of Search ..... 68/20, 181 R, 68/8, 19, 903, 200–204, 205 R, 205 D, 205 E, 207, 208; 134/122 R, 55, 64 R, 68; 34/605, 115; 28/104, 105, 106, 167; 15/300.1, 302, 303, 305, 306.1, 307, 309.1, 320, 322, 312.1, 312.2

(56) References Cited

U.S. PATENT DOCUMENTS 1,759,804 A * 5/1930 Pieron ..... 34/655
3,841,910 A * 10/1974 Baker ..... 134/15
3,992,746 A * 11/1976 Rhodes ..... 15/307
4,166,368 A * 9/1979 Beninca' et al. ..... 68/20
4,197,609 A * 4/1980 Fuhring ..... 15/309.1
4,269,047 A * 5/1981 Schuierer ..... 68/181 R
4,691,417 A * 9/1987 Vuillaume ..... 28/105
5,718,022 A * 2/1998 Vuillaume ..... 28/105
5,727,292 A * 3/1998 Vuillaume ..... 28/104
6,324,738 B1 * 12/2001 Fleissner ..... 28/104
6,338,187 B1 * 1/2002 Fleissner ..... 28/106
6,412,140 B1 * 7/2002 Fleissner ..... 15/309.1

FOREIGN PATENT DOCUMENTS

DE 4436745 A1 * 4/1996
EP 0753619 A2 * 1/1997
EP 0853156 A2 * 7/1998

* cited by examiner

*Primary Examiner*—A. Vanatta
(74) *Attorney, Agent, or Firm*—Antonelli, Terry, Stout and Kraus, LLP.

(57) ABSTRACT

A suction device for use in a textile machine, especially a water jet weaving installation has a slot between two glide strips for a transport device transporting the textile material that terminates radially inwards in a stationary suction tube into the thicker wall of which a suction slot is milled across the entire working length, thereby removing the need for bores having intermediate webs that are soiled by the lint suctioned off. The longitudinal slot in the suction tube is held at the desired distance by U-shaped straps that are distributed across the length of the slot. The straps are held on the suction tube by screws and are arrow-shaped in the zone of their base limbs so that the lint is unimpeded as it flows past this surface.

8 Claims, 1 Drawing Sheet

SUCTION DEVICE FOR USE IN A TEXTILE MACHINE, ESPECIALLY A WATER JET WEAVING INSTALLATION

The invention relates to a suction device for fluids, specifically on water needling machines in which, on the exterior, a water beam to generate fluid jets is associated with the suction device, said water beam possibly consisting of a suction tube with suction openings located along the working length of the tube, through which openings the fluid is extracted by a partial vacuum generated in the tube, and wherein slide strips or the like are located on both sides of and parallel to the openings along the tube to support a transport means such as drums for the web-shaped material to be needled. Due to the partial vacuum generated between 20 mbar and 400 mbar, the fixed suction tube must be of a very stable design. The suction tube is thus constructed with a thick wall into which the suction openings are drilled. The slide strips for the transporting drum or a band are then fixed laterally to these openings introduced along a paraxial generating line which define by their distance the effective suction slit.

With multiple sequentially arranged needling, the dewatering process is critical for the needling effect ultimately obtained. For this reason, the partial vacuum must be as high as possible. This partial vacuum must also, however, always act uniformly on the fabric—a condition which is difficult to achieve given lint-generating fabric webs. There is the danger that the suction slit or sections of the suction slit will become clogged by residual fibers. Regular cleaning is therefore required.

As German Patent DE-A-199 25 703 proposes, rapid cleaning is possible if the suction slit is formed within an insert strip. Whenever the suction openings in the suction tube align with the openings in the insert strip, the lint does not collect on the ribs of the suction tube but on the ribs in the insert strip, which may then be easily removed for cleaning.

Cleaning is required, however, on a routine basis. The goal of the invention is therefore to modify the device of the known type so as not only to obviate the need for cleaning the suction slit to remove fibers trapped therein but to optimize the suction slit in terms of its function such that the partial vacuum on the face of the suction slit continues to act with unimpaired efficiency on the fabric web to be dewatered.

Starting with the suction device of the type referred to at the outset, the goal is achieved by having the suction tube slotted continuously lengthwise along at least a major section of the length of the working width and retaining this slit at slit width with braces attached radially inside the tube along the walls of the slit. As a result, the suction slit defined between the slide strips now has no inserts; neither does the aligning slit in the suction tube. This tube, in other words, now has no drilled holes for the passage of the water, but only this slit instead. Depending on the required working width and thus the length of the tube, however, the tube would over time bend upward without additional retention means for the generated slit width. To prevent this from occurring, two or more braces which retain the slit at the production width are attached to the interior side of the tube. While these braces do impart a certain resistance to the flow of water or detached fibers, this effect is small since the braces are separated from the suction slit when contacting the fabric and may additionally be optimized at least in terms of their contact surface.

One possible means of optimizing flow resistance is to provide the braces with a U-shape, with the result that the contact surface is even further removed from the action of the jets during water needling; while additionally these resistance surfaces may be rounded off or blade-shaped. The result is self-cleaning.

The invention is not restricted only to water needling machines but is applicable to all suction devices required for dewatering in the textile industry.

An example of a device of the type according to the invention is presented in the drawing. Additional inventive details will be explained based on this example.

FIG. 1 is a cross-section of a roller for hydrodynamically needling a nonwoven material or the like.

Figure 1:
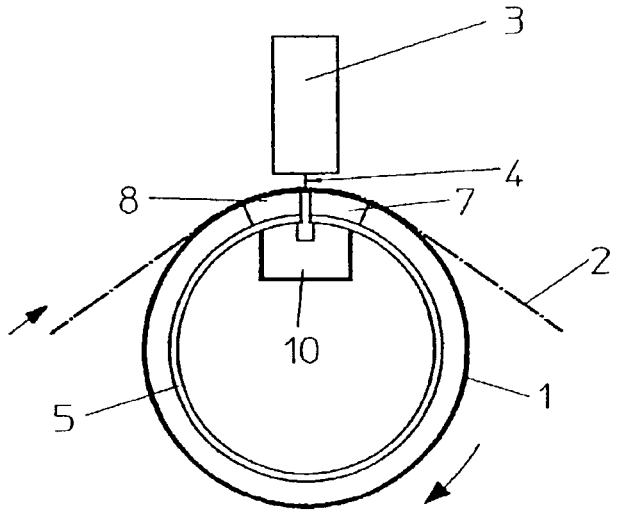

The suction device consists, for example, of a fluid-permeable, rotatably supported drum 1, preferably driven, on which the needling material 2 rests. On the top, a water beam 3 is associated with drum 1, from which water beam high-pressure water jets 4 emerge and strike material 2. The water sprayed on must then be immediately suctioned off below material 2. To accomplish this, a suction tube 5 is mounted centrically fixed within drum 1, into the wall of which tube a longitudinal slit 6 has been introduced along a generating line. Stop braces 10 are associated radially inwards from suction tube 5 with longitudinal slit 6, which braces fix the production width of longitudinal slit 6. To define the width of the actual suction slit 9, slide strips 7, 8 or the like are fixed parallel to the generating line radially outside suction tube 5 to the right and left of this longitudinal slit 6.

Figure 2:
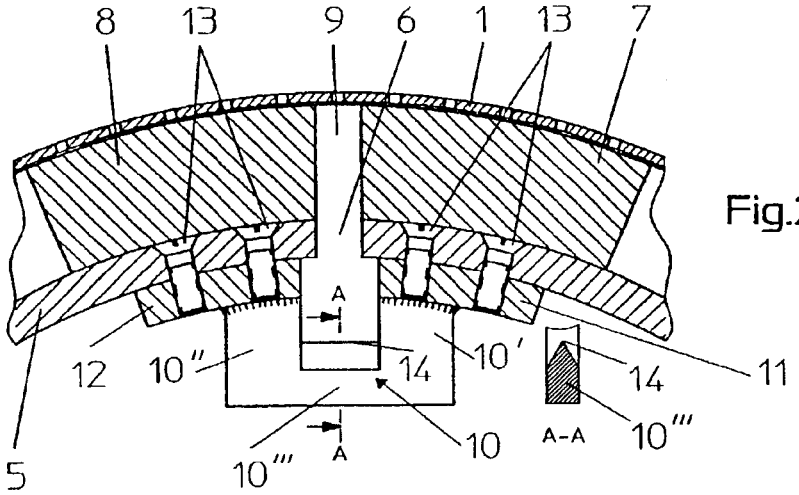
FIG. 2 is an enlargement of the suction slit of FIG. 1.
Figure 3:
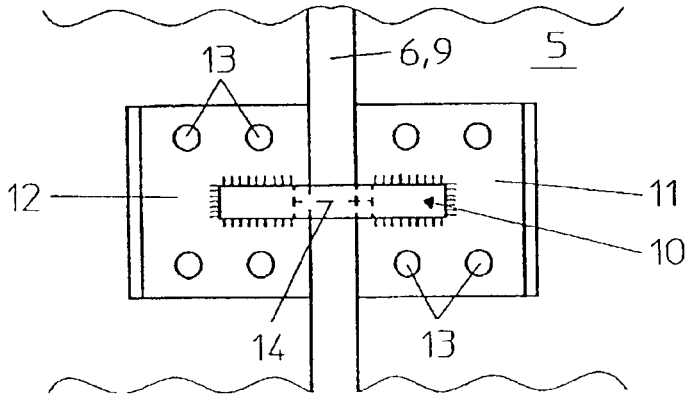
FIG. 3 is a radially outward facing view of the brace fixing the longitudinal slit in the suction tube.

The details of stop brace 10 are seen in FIG. 2. Due to slide strips 7, 8, suction slit 9 is uniformly wide and continuously open over the length of suction tube 5. Slide strips 7, 8 rest on suction tube 5. In place of the multiple suction holes commonly used previously, suction tube 5 now has one longitudinal slit 6 in the stable tube wall, which slit aligns with suction slit 9. This feature optimizes the effect of the suction generated in tube 5 and avoids the ribs between the commonly used holes on which lint always collected. Depending on the length of the suction device or the working width of the needling device, longitudinal slit 6 must, however, also be quite long. A support to retain the dimensioning of longitudinal slit 6, and thus suction slit 9, is therefore absolutely necessary.

This support must be designed so that the suction maintains an unchanging effect along suction slit 9 and also creates no resistance to the water removed from material 2 and the lint removed with the water. The support is created—depending on the length of suction slit 9—by one or more braces 10. Braces 10 are U-shaped; with their two legs 10' and 10" they face radially outward and are retained on suction tube 5 by two attachment flanges 11, 12 with screws 13, said flanges being matched to the curve of suction tube 5. The ends of legs 10' and 10" are welded onto attachment flanges 11, 12, and screws 13 are moved radially outward through the wall of suction tube 5 into flanges 11, 12, thereby pressing flanges 11, 12 against the interior wall of suction tube 5. The planar resistance to the lint flowing with the water is limited to the area of the base leg 10'" of brace 10; however this resistance is oriented radially inwards by a considerable amount and may be further prevented by the arrow-shaped cross-sectional area shown in section A—A in the impingement area. The lint here flowing by the edge 14 of base leg 10'" cannot collect, and will in any case constantly result in self-cleaning of brace 10.

What is claimed is:

1. Suction device for fluids in water needling machines in which, on the exterior, a water beam to generate fluid jets is associated with said suction device, said suction device comprising a suction tube with suction openings located along a working length of the tube, through which openings the fluid is extracted by a partial vacuum generated in the tube, and wherein slide strips are located on both sides and parallel to the openings along the tube to support a transport means for the web-shaped material to be needled, characterized in that the suction openings comprise a slot extending continuously lengthwise along at least a major section of the length of the working width, and this slot is retained at a slot width with braces attached radially inside the tube along opposed walls of the slot.

2. Suction device according to claim 1, characterized in that the suction tube is slotted continuously along the entire length of the working width, and the braces are attached at multiple points along this length to the sides of the slot.

3. Suction device according to claim 1, characterized in that the braces are screwed to the sides of the slot.

4. Suction device according to claim 1, characterized in that the braces are provided with one flange each at their two ends, which flanges are each held against the suction tube by the walls of the suction tube.

5. Suction device according to claim 4, characterized in that the flanges of the braces are retained by screws that are inserted along with their respective screw heads from outside the wall of the suction tube and that extend through the wall of the suction tube into the flanges.

6. Suction device according to claim 1, characterized in that the braces are U-shaped.

7. Suction device according to claim 1, characterized in that the braces have a rounded shape on a leg of the brace in a region associated with the suction slot.

8. Suction device according to claim 1, characterized in that the braces have a blade shape cross-section in a center section in the region associated with the suction.

* * * * *